US005935387A

United States Patent [19]

Tratz et al.

[11] Patent Number: 5,935,387

[45] Date of Patent: Aug. 10, 1999

[54] METHOD AND DEVICE FOR HEATING A LOW TEMPERATURE CARBONIZATION DRUM AND LOW TEMPERATURE CARBONIZATION/COMBUSTION PLANT HAVING THE DEVICE

[75] Inventors: Herbert Tratz, Ottensoos; Reiner Engelhardt, Effeltrich; Georg Lösel, Uttenreuth, all of Germany

[73] Assignee: Siemens Aktiengesellschaft, Munich, Germany

[21] Appl. No.: 08/291,768

[22] Filed: Aug. 17, 1994

Related U.S. Application Data

[63] Continuation of application No. PCT/DE93/00119, Feb. 11, 1993.

[30] Foreign Application Priority Data

Feb. 17, 1992 [DE] Germany ..... 42 04 728
May 25, 1992 [DE] Germany ..... 42 17 301

[51] Int. Cl.[6] ..... C10B 21/20

[52] U.S. Cl. ..... 202/99; 202/91; 202/108; 202/226; 202/262

[58] Field of Search ..... 202/91, 99, 108, 202/226, 262; 201/2.5, 13, 15, 27, 29, 37

[56] References Cited

U.S. PATENT DOCUMENTS

| | | | |
|---|---|---|---|
| 3,970,524 | 7/1976 | Funk | 201/2.5 |
| 3,971,704 | 7/1976 | von Klenck et al. | 201/2.5 |
| 4,368,103 | 1/1983 | Weinzierl et al. | 202/99 |
| 5,302,254 | 4/1994 | Martin et al. | 201/21 |

FOREIGN PATENT DOCUMENTS

| | | |
|---|---|---|
| 0340537 | 11/1989 | European Pat. Off. . |
| 2244753 | 10/1973 | Germany . |
| 3018572 | 11/1981 | Germany . |
| 3815187 | 11/1989 | Germany . |

OTHER PUBLICATIONS

Publication: Prolyse von Abfällen (Pyrolysis of Waste) Karl J. Thomè–Komiensky 1985, pp. 97–151.

*Primary Examiner*—Glenn Caldarola
*Attorney, Agent, or Firm*—Herbert L. Lerner; Laurence A. Greenberg

[57] ABSTRACT

A method for heating a low temperature carbonization drum includes generating a low temperature carbonization gas in the drum; combusting a partial flow of the low temperature carbonization gas for generating a heating gas; conducting the heating gas in a heating gas circuit; preheating the cooled heating gas flowing out of the drum; and then returning a controllable partial flow of the cooled heating gas to the drum while re-admixing the controllable partial flow with the heating gas. A device for heating the low temperature carbonization drum includes a heating gas circuit having an inflow line and an outflow line connected to the drum generating low temperature carbonization gas; the heating gas circuit having a combustion chamber for receiving a partial flow of the low temperature carbonization gas from the drum and generating a heating gas to be delivered to the drum; and the heating gas circuit having a heat exchanger connected upstream of the combustion chamber for preheating the heating gas being cooled in the drum. A low temperature carbonization/combustion plant includes a combustion chamber of a combustion system receiving a remaining flow of the low temperature carbonization gas generated in the drum. The combustion system produces steam to be supplied to the heat exchanger.

10 Claims, 1 Drawing Sheet

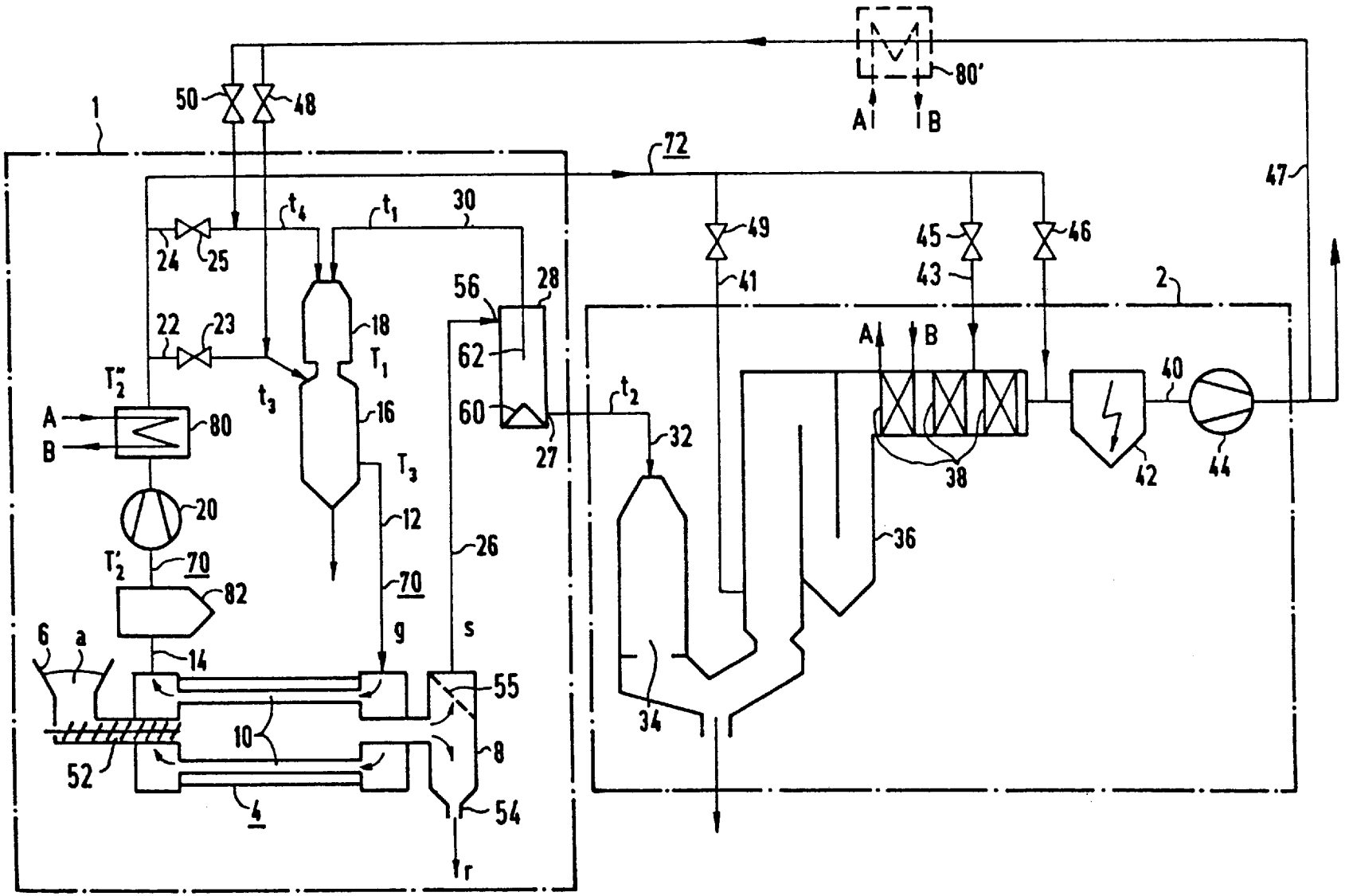
47
44
40
42
2
46
45
43
38
36
80'
B
A
49
41
72
32
34
28
27
56
62
60
30
26
s
55
8
54
r
12
70
g
18
16
10
4
48
50
25
24
23
22
80
20
82
14
52
1
6
a

METHOD AND DEVICE FOR HEATING A LOW TEMPERATURE CARBONIZATION DRUM AND LOW TEMPERATURE CARBONIZATION/COMBUSTION PLANT HAVING THE DEVICE

CROSS-REFERENCE TO RELATED APPLICATION

This application is a Continuation of International Application Serial No. PCT/DE93/00119, filed Feb. 11, 1993.

BACKGROUND OF THE INVENTION

1. Field of the Invention

The invention relates to a method for heating a low temperature carbonization drum for generating a low temperature carbonization gas, wherein a heating gas conducted in a heating gas circuit is generated by combustion of a partial flow of the low temperature carbonization gas. The invention further relates to a device for carrying out the method and to a low temperature carbonization/combustion plant operating according to the method.

The low temperature carbonization of waste at a low temperature is an endothermic process. The heat required for the reaction is supplied to the waste indirectly through heat exchanger heating surfaces, which are disposed in the form of tubes in the wall of a rotary drum or low temperature carbonization drum.

In a method for thermal waste disposal known from Published European Application No. 0 340 537 A1, a heating gas that is carried in a heating gas circuit is supplied to the low temperature carbonization drum. In a low temperature carbonization/combustion system operating according to that method, the heating gas circuit includes a heat exchanger that is disposed at a combustion chamber of the combustion system, where it absorbs heat energy from the hot flue gas. The low temperature carbonization system is practically always operated together with the combustion system, and the low temperature carbonization gas being generated is combusted in the combustion system to produce steam.

An autonomously heatable low temperature carbonization system is known from German Published, Non-Prosecuted Application DE 30 18 572 A1. In the low temperature carbonization or pyrolysis system described therein, a partial flow of the low temperature carbonization gas being produced is combusted in a combustion chamber. The resultant flue gas is used as heating gas for the low temperature carbonization drum and after passing through a heat exchanger is given off to the environment.

An autonomously operable low temperature carbonization system is known from the publication entitled "Pyrolyse von Abfällen" [Pyrolysis of Waste] by Karl J. Thome-Kozmiensky, published by EF-Verlag für Energie- und Umwelttechnik GmbH, 1985, pp. 97–120, particularly FIG. 2 on page 101 and the text on page 103. In that known system, all of the low temperature carbonization gas being produced is converted into a pure gas in a gas converter with a downstream scrubbing line. Some of the pure gas is combusted in a combustion chamber. The flue gas thus produced is carried to an essentially open circuit and is used as heating gas for the low temperature carbonization drum. However, that method is especially complicated and uneconomical, especially since an already commercially usable pure gas is used for generating the heating gas.

SUMMARY OF THE INVENTION

It is accordingly an object of the invention to provide a method and a device for heating a low temperature carbonization drum and a low temperature carbonization/combustion plant having the device, which overcome the hereinafore-mentioned disadvantages of the heretofore-known methods and devices of this general type and which provide an economical method for heating a low temperature carbonization drum, wherein an adequate quantity of heat is always intended to be imported into the low temperature carbonization drum with the heating gas. It is also an object to achieve this with a largely simplified device that assures the furnishing of a heating gas required for the autonomous operation of the low temperature carbonization system.

With the foregoing and other objects in view there is provided, in accordance with the invention, a method for heating a low temperature carbonization drum, which comprises generating a low temperature carbonization gas in a low temperature carbonization drum; combusting a partial flow of the low temperature carbonization gas for generating a heating gas; conducting the heating gas in a heating gas circuit; preheating the cooled heating gas flowing out of the low temperature carbonization drum; and then returning a controllable partial flow of the cooled heating gas to the low temperature carbonization drum while re-admixing the controllable partial flow with the heating gas.

In order to adjust the temperature of the heating gas, which is generated by combustion of a partial flow of the heating gas, a controllable partial flow of the cooled heating gas is returned to the low temperature carbonization drum in a closed partial circuit and in the process is re-admixed with the heating gas.

Since the partial flow of the low temperature carbonization gas advantageously has dust removed from it prior to the combustion, the possibility exists of dust being deposited in the heating gas circuit, particularly in the low temperature carbonization drum, during operation of the low temperature carbonization system. The quantity of dust that comes to be deposited can be reduced by decreasing the partial flow of low temperature carbonization gas to be combusted. However, that leads to a reduction in the quantity of heat imported into the low temperature carbonization drum along with the heating gas. In order to supply the missing quantity of heat to the heating gas, the cooled heating gas flowing out of the low temperature carbonization drum is first preheated.

Next, the preheated heating gas, together with the combusted partial flow of low temperature carbonization gas, is returned to the low temperature carbonization drum. A partial flow of the heating gas flowing out of the low temperature carbonization drum is diverted from the heating gas circuit before or after preheating.

In accordance with another mode of the invention, the partial flow of the low temperature carbonization gas is conducted at the negative pressure prevailing in the heating gas circuit. On one hand, this provision serves to move the partial flow of low temperature carbonization gas and resultant heating gas onward in the heating gas circuit. On the other hand, it avoids an escape of low temperature carbonization gas or heating gas to the environment in the event of a leak.

In accordance with a further mode of the invention, the preheating of the cooled heating gas is suitably performed by indirect heat exchange with steam.

In accordance with an added mode of the invention, the cooled heating gas has dust removed from it prior to the preheating.

With the objects of the invention in view, there is also provided a device for heating a low temperature carbonization drum, comprising a heating gas circuit having an inflow line and an outflow line connected to a low temperature carbonization drum generating low temperature carbonization gas; the heating gas circuit having a combustion chamber for receiving a partial flow of the low temperature carbonization gas from the low temperature carbonization drum and generating a heating gas to be delivered to the low temperature carbonization drum; and the heating gas circuit having a heat exchanger connected upstream of the combustion chamber for preheating the heating gas being cooled in the low temperature carbonization drum.

In accordance with another feature of the invention, there is provided a device, preferably a cyclone, connected upstream of the combustion chamber for dust separation.

In accordance with a further feature of the invention, there is provided a suction ventilator connected into the outflow line of the heating gas circuit.

In accordance with an added feature of the invention, the suction ventilator has a pressure side communicating with the combustion chamber.

In accordance with an additional feature of the invention, there is provided a mixing chamber connected downstream of the combustion chamber, the suction ventilator having a pressure side communicating with the mixing chamber.

In accordance with a concomitant feature of the invention, there is provided a device connected upstream of the heat exchanger in the outflow line for dust separation.

In a low temperature carbonization/combustion system operating according to the method of the invention and having a low temperature carbonization drum for generating low temperature carbonization gas, a partial flow, preferably from 20 to 50%, of the low temperature carbonization gas being generated, can be supplied to a first combustion chamber for generating the heating gas for the low temperature carbonization drum. In order to provide steam generation, the remaining flow of the low temperature carbonization gas being generated is supplied to a combustion chamber of the combustion system. Steam produced in the combustion system can be supplied to a heat exchanger upstream of the first combustion chamber in the heating gas circuit. As a result, the cooled heating gas is preheated with the steam by indirect heat exchange.

The advantages attained with the invention are in particular that by using a partial flow of the low temperature carbonization gas to produce the heating gas required for the low temperature carbonization, the low temperature carbonization system can be operated autonomously in an especially economical way. This low temperature carbonization system can therefore be used for retrofitting of an existing combustion or furnace system. The excess low temperature carbonization gas and the residue produced from the low temperature carbonization drum can be combusted in the combustion system. No transport of heat or material with the crosswise connections that are required, for instance, in the prior art defined by Published European Application No. 0 340 537 A1 between the existing combustion system and the supplied or retrofitted low temperature carbonization system, is needed for heating the systems.

Other features which are considered as characteristic for the invention are set forth in the appended claims.

Although the invention is illustrated and described herein as embodied in a method and a device for heating a low temperature carbonization drum and a low temperature carbonization/combustion plant having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a schematic and diagrammatic circuit diagram of an exemplary embodiment of a low temperature carbonization/combustion system with a device for heating gas generation, having a heat exchanger connected to a heating gas circuit at two alternative points, according to the invention.

DESCRIPTION OF THE PREFERRED EMBODIMENTS

Referring now to the single FIGURE of the drawing in detail, there is seen a low temperature carbonization/combustion plant which includes a carbonization system 1 and a combustion system 2 connected downstream thereof. The carbonization system 1 includes a low temperature carbonization drum 4 with a charging device 6 for waste a and a discharge chamber 8 for separating a generated low temperature carbonization gas s from an outgassed residue r. Heating tubes 10 that are acted upon by a heating gas g are disposed in the low temperature carbonization drum 4. An inflow line 12 and an outflow line 14 are connected to the low temperature carbonization drum 4. The inflow line 12 communicates with a mixing chamber 16, to which a combustion chamber 18 is connected upstream. A blower or suction ventilator 20 is located in the outflow line 14. A first branch 22 of the outflow line 14 communicates with the mixing chamber 16. A second branch 24 of the outflow line 14 communicates with the combustion chamber 18. One valve 23, 25 is located in each of the respective branches 22, 24.

The discharge chamber 8 communicates through a line 26 with a device 28 for dust separation, such as a cyclone. The device 28 communicates with the combustion chamber 18 through a line 30. One outlet 27 of the device 28 communicates through a line 32 with a combustion chamber 34 of the combustion system 2.

A waste heat boiler or cooler 36 which is connected downstream of the combustion chamber 34 has heating surfaces 38. A device 42 for flue gas cleaning and a further blower or suction ventilator 44 are connected into a flue gas line 40. The flue gas line 40 discharges into a non-illustrated chimney.

The outflow line 14 of the low temperature carbonization drum 4 discharges through a valve 46 into the flue gas line 40 at a region between the waste heat boiler 36 and the cleaning device 42. A parallel branch 43 with a valve 45 ends in a region of the waste heat boiler 36 between adjacent heating surfaces 38. The flue gas line 40 communicates with the branch 22 or the branch 24 of the outflow line 14 through a line 47 and respective valves 48 and 50.

The low temperature carbonization drum 4 is supplied with the waste a through a feeder device 52. The waste a is pyrolyzed or combusted at low temperature in the low temperature carbonization drum 4 through the use of the tubes 10 which are heated with hot flue gas or heating gas g. The resultant low temperature carbonization gas s and the outgassed residue r are separated from one another in the discharge chamber 8. The residue r is supplied for further processing through a discharge opening 54. It may be combusted in the combustion chamber 34, for instance. The low temperature carbonization gas s is crudely cleaned by means of a sieve or filter 55, which traps fibers and large pieces, and is then aspirated into the device 28 through the line 26. The low temperature carbonization gas s contains several weight % of fine dust with a larger proportion of combustible material.

The low temperature carbonization gas s enters the device 28 at the top, at a tangent, through an inlet opening 56, which is constructed in a non-illustrated manner in the form of a relatively high, narrow slit. Due to centrifugal force, dust particles upon diversion inside the device 28 are pressed against the wall. As a result, a reduction in dust in the center is achieved.

A low-dust partial flow $t_1$ of 20 to 50% and preferably 30%, of the low temperature carbonization gas s, is taken from the device 28 through a suction exhaust tube 62 extending far across the inlet opening 56, and is delivered to the combustion chamber 18 for combustion.

Varying the structure of the suction exhaust tube 62 makes it possible to lower the dust content in the partial flow $t_1$ and the low temperature carbonization gas s even further. For instance, longitudinal slits in the suction exhaust tube 62 have an advantageous effect on dust separation, because they lower the entry speed and make it more uniform.

The partial flow $t_1$ of the low temperature carbonization gas s, from which dust has been removed or which has reduced dust, is used for generating heating gas. To that end, the partial flow $t_1$ of the low temperature carbonization gas s is combusted in the combustion chamber 18 at a temperature $T_1$ of approximately 1250° C. The heating gas g which flows out of the low temperature carbonization drum 4 and is cooled down to a temperature $T_2'$ of approximately 250° C., is first preheated to a temperature $T_2''$ of approximately 360° C. in a heat exchanger 80 which is connected to the outflow line 14 on the pressure side of the blower 20. Next, an adjustable partial flow $t_3$ of the heated heating gas g is carried through the branch 22 into the mixing chamber 16. There it is mixed with the heating gas g from the combustion chamber 18, so that upon entry into the low temperature carbonization drum 4, a mixing temperature $T_3$ of approximately 520° C. is established. A partial flow $t_4$ of the preheated heating gas g, which is adjustable by means of the valve 25, can be supplied directly to the combustion chamber 18. At least a portion of the heating gas g thus flows through the mixing chamber 16 and the inflow line 12, as well as through the heating tubes 10 and the heat exchanger 80 and through the branches 22, 24 of the outflow line 14, in a closed partial circuit 70.

The outlet opening 27 of the device 28 for a mainstream or remaining flow $t_2$ of the low temperature carbonization gas s is likewise located at a tangent in the lower region of the device 28. The dust which is concentrated toward the wall reaches the combustion chamber 34 through the line 32 along with the remaining flow $t_2$. The direction of rotation of the flow of low temperature carbonization gas s is the same after entering the device 28 and before emerging from the device 28. A bottom region 60 of the device 28 is raised in conical or parabola-shaped fashion toward the middle, so that no dust deposits can form there.

The hot flue gas produced in the combustion of the remaining flow $t_2$ of the low temperature carbonization gas s in the combustion chamber 34 is used for steam generation in the waste heat boiler 36. The transport of this remaining flow $t_2$ of the low temperature carbonization gas s from the low temperature carbonization drum 4 through the device 28 and the combustion chamber 34 and through the waste heat boiler 36 and the cleaning system 42 takes place through the suction ventilator 44.

The heating gas g which is not needed for generating heating gas flows in an open circuit 72 through the valve 46 and is admixed upstream of the cleaning device 42 with the flue gas flowing out of the combustion chamber 34. Thus only completely combusted flue gas is cleaned in the cleaning device 42.

Steam from the waste heat boiler 36 serves as a heat carrier for the heat exchanger 80. This steam is taken at a point A from the heating surfaces 38 and supplied to the heat exchanger 80 at an inlet temperature of approximately 390° C. The cooled steam emerging from the heat exchanger 80 at a point B flows back to the heating surfaces 38 at a temperature of approximately 330° C.

In order to achieve further dust reduction in the heating gas g, a dust separator 82 is disposed in the outflow line 14 on the intake or suction side of the blower 20.

With the valves 23 and 25 being closed, the heating gas g from the low temperature carbonization drum 4 is carried in the circuit 72, and in the process it is admixed with the flue gas through a valve 49 and a line 41 disposed upstream and through the valve 46 disposed downstream, of the waste heat boiler 36. The cleaning of the gas mixture takes place solely in the device 42. The heating gas circuit 72 is closed through the line 47 and the valves 48 and 50, and a heat exchanger 80' is then located in the line 47. In that case, clean flue gas is withdrawn on the pressure side of the blower 44 and preheated in the heat exchanger 80' disposed in the line 47. Then the preheated flue gas is admixed once again with the heating gas g.

The autonomously operable carbonization system 1 is especially advantageously suitable for retrofitting of an existing combustion system 2. All that needs to be done is essentially to make a connection through the line 32.

We claim:

1. A device for heating a low temperature carbonization drum, comprising:

a heating gas circuit having an inflow line and an outflow line connected to a carbonization drum generating carbonization gas;

said heating gas circuit having a combustion chamber communicating with said carbonization drum, said combustion chamber receiving and combusting a partial flow of the carbonization gas from the carbonization drum, thereby generating a heating gas, and delivering the heating gas to the carbonization drum; and said heating gas circuit having a heat exchanger connected between the carbonization chamber and said combustion chamber for preheating the heating gas received from the carbonization drum.

2. The device according to claim 1, including a device connected upstream of said combustion chamber for dust separation.

3. The device according to claim 2, wherein said dust separation device is a cyclone.

4. The device according to claim 1, including a suction ventilator connected into said outflow line of said heating gas circuit.

5. The device according to claim 4, wherein said suction ventilator has a pressure side communicating with said combustion chamber.

6. The device according to claim 4, including a mixing chamber connected downstream of said combustion chamber, said suction ventilator having a pressure side communicating with said mixing chamber.

7. The device according to claim 1, including a device connected upstream of said heat exchanger in said outflow line for dust separation.

8. A low temperature carbonization/combustion plant, comprising:

a combustion system including a combustion chamber; and a device for heating a carbonization drum including a heating gas circuit having an inflow line and an outflow line connected to a carbonization drum generating carbonization gas; said heating gas circuit having a combustion chamber for receiving and combusting a partial flow of the carbonization gas from the carbonization drum and thereby generating a heating gas to be delivered to the carbonization drum; and said heating gas circuit having a heat exchanger connected upstream of said combustion chamber for preheating the heating gas being cooled in the carbonization drum;

said combustion chamber of said combustion system receiving a remaining flow of the carbonization gas generated in the carbonization drum.

9. The low temperature carbonization/combustion plant according to claim 8, wherein said combustion system produces steam to be supplied to said heat exchanger.

10. A low temperature carbonization/combustion plant, comprising:

a combustion system producing steam; and a device for heating a low temperature carbonization drum including a heating gas circuit having an inflow line and an outflow line connected to a low temperature carbonization drum generating low temperature carbonization gas; said heating gas circuit having a combustion chamber for receiving and combusting a partial flow of the low temperature carbonization gas from the low temperature carbonization drum and thereby generating a heating gas to be delivered to the low temperature carbonization drum; and said heating gas circuit having a heat exchanger connected upstream of said combustion chamber for preheating the heating gas being cooled in the low temperature carbonization drum;

said heat exchanger receiving the steam produced in said combustion system.

* * * * *